US006797147B2

(12) United States Patent
Dolan

(10) Patent No.: US 6,797,147 B2
(45) Date of Patent: Sep. 28, 2004

(54) LIGHT METAL ANODIZATION

(75) Inventor: Shawn E. Dolan, Sterling Heights, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 88 days.

(21) Appl. No.: 10/262,772

(22) Filed: Oct. 2, 2002

(65) Prior Publication Data

US 2003/0079994 A1 May 1, 2003

Related U.S. Application Data

(63) Continuation-in-part of application No. 10/162,965, filed on Jun. 5, 2002, which is a continuation-in-part of application No. 10/033,554, filed on Oct. 19, 2001, which is a continuation-in-part of application No. 09/968,023, filed on Oct. 2, 2001.

(51) Int. Cl.[7] ..... C25D 9/06

(52) U.S. Cl. ..... 205/316; 205/321; 205/324; 205/325; 205/326

(58) Field of Search ..... 205/316, 321, 205/324, 325, 326

(56) References Cited

U.S. PATENT DOCUMENTS

| | | | |
|---|---|---|---|
| 2,305,669 | A | 12/1942 | Budiloff et al. |
| 2,880,148 | A | 3/1959 | Evangelides |
| 2,901,409 | A | 8/1959 | DeLong |
| 2,926,125 | A | 2/1960 | Currah et al. |
| 3,345,276 | A | 10/1967 | Munroe |
| 3,620,940 | A | 11/1971 | Wick |
| 3,824,159 | A | 7/1974 | Wehrmann |
| 3,945,899 | A | 3/1976 | Nikaido et al. |
| 3,956,080 | A | 5/1976 | Hradcovsky et al. |
| 3,960,676 | A | 6/1976 | Miyosawa et al. |
| 3,996,115 | A | 12/1976 | Kessler |
| RE29,739 | E | 8/1978 | Kessler |
| 4,166,777 | A | 9/1979 | Casson, Jr. et al. |
| 4,184,926 | A | 1/1980 | Kozak |
| 4,188,270 | A | 2/1980 | Kataoka |
| 4,227,976 | A | 10/1980 | Menke |
| 4,383,897 | A | 5/1983 | Gillich et al. |
| 4,399,021 | A | 8/1983 | Gillich et al. |
| 4,439,287 | A | 3/1984 | Birkle et al. |
| 4,448,647 | A | 5/1984 | Gillich et al. |
| 4,452,674 | A | 6/1984 | Gillich et al. |
| 4,551,211 | A | 11/1985 | Kobayashi et al. |
| 4,578,156 | A | 3/1986 | Plazter |
| 4,620,904 | A | 11/1986 | Kozak |
| 4,659,440 | A | 4/1987 | Hradcovsky |
| 4,668,347 | A | 5/1987 | Habermann et al. |

(List continued on next page.)

FOREIGN PATENT DOCUMENTS

| | | |
|---|---|---|
| DE | 28 90 54 A5 | 4/1991 |
| DE | 289065 A5 | 4/1991 |
| DE | 41 04 847 | 8/1992 |
| EP | 0978576 | 2/2000 |
| EP | 1002644 | 5/2000 |
| EP | 0 780 494 B1 | 11/2002 |
| FR | 2657090 | 7/1991 |
| GB | 294237 | 9/1929 |
| GB | 493935 | 10/1938 |
| GB | 2343681 | 5/2000 |
| JP | 57060098 | 4/1982 |
| JP | 58001093 | 1/1983 |
| RU | 2049162 | 11/1995 |
| RU | 2112087 | 5/1998 |
| SU | 617493 | 7/1978 |
| WO | WO 9214868 | 9/1992 |
| WO | WO 98/42892 | 3/1998 |
| WO | WO 99/02759 | 7/1998 |
| WO | WO 98/42895 | 10/1998 |
| WO | WO 00/03069 | 1/2000 |
| WO | WO02/28838 A2 | 4/2002 |

OTHER PUBLICATIONS

DE 4104847 abstract (no date).

FR 2549092 abstract (no date).

Zozulin, Alex J.; "A Chromate–Free Anodize Process for Magnesium Alloys: A Coating with Superior Characteristics", pp 47–63 (no date).

Zozulin, et al.; "Anodized Coatings for magnesium Alloys", Metal Finishing, Mar., 1994, pp 39–44.

IBM Technical Disclosure Bulletin, "Forming Protective Coatings on Magnesium Alloys", Dec., 1967, p. 862.

Jakobson, et al.; American Electroplaters and Surface Finishers Society, pp. 541–550 (no date).

Barton, et al.; "The Effect of electrolyte on the Anodized Finish of a magnesium Alloy"; Plating & Surface Finishing, pp. 138–141 (no date).

Barton, et al.; "The Effect of electrolyte on the Anodized Finish of a Magnesium Alloy"; Plating & Surface Finishing, May 1995, pp. 138–141.

"Sworn Declaration of Dr. Peter Kurze dated Jul. 5, 2000, submitted in connection with PCT Publication WO 96/28591 of Magnesium Technology Limited".

Barton, et al.; "The Effect of Electrolyte on the Anodized Finish Of a Magnesium Alloy"; Plating & Surface Finishing, May 1995, pp. 138–141.

"Sworn Declaration of Dr. Peter Kurze dated Jul. 5, 2000, submitted in connection with PCT Publication WO 96/28591 of Magnesium Technology Limited".

*Primary Examiner*—Robert R. Koehler
(74) *Attorney, Agent, or Firm*—Stephen D. Harper; Mary K. Cameron

(57) ABSTRACT

Using aqueous electrolytes containing complex fluorides or oxyfluorides such as fluorozirconates, fluorotitanates, and fluorosilicates, articles containing light metals such as magnesium and aluminum may be rapidly anodized to form protective surface coatings. White coatings may be formed on aluminum articles using pulsed direct current or alternating current. When the article to be anodized is comprised of magnesium, pulsed direct current having a relatively low average voltage is preferably used.

32 Claims, No Drawings

U.S. PATENT DOCUMENTS 4,744,872 A 5/1988 Kobayashi et al.
4,859,288 A 8/1989 Furneaux et al.
4,869,789 A 9/1989 Kurze et al.
4,976,830 A 12/1990 Schmeling et al.
4,978,432 A 12/1990 Schmeling et al.
5,240,589 A 8/1993 Bartak et al.
5,264,113 A 11/1993 Bartak et al.
5,266,412 A 11/1993 Bartak et al.
5,275,713 A 1/1994 Hradcovsky
5,281,282 A 1/1994 Dolan et al. ..... 148/247
5,385,662 A 1/1995 Kurze et al.
5,470,664 A 11/1995 Bartak et al.
5,700,366 A 12/1997 Steblianko et al.
5,775,892 A 7/1998 Miyasaka et al.
5,792,335 A 8/1998 Barton
5,811,194 A 9/1998 Kurze et al.
5,837,117 A 11/1998 Allegret
5,958,604 A 9/1999 Riabkov et al.
5,981,084 A 11/1999 Riabkov et al.
6,059,897 A 5/2000 Koerner et al.
6,159,618 A 12/2000 Danroc et al.
6,197,178 B1 3/2001 Patel et al.
6,280,598 B1 8/2001 Barton et al.
6,335,099 B1 1/2002 Higuchi et al.

LIGHT METAL ANODIZATION

This application is a continuation-in-part of application Ser. No. 10/162,965, filed Jun. 5, 2002, which is a continuation-in-part of application Ser. No. 10/033,554, filed Oct. 19, 2001, which is a continuation-in-part of application Ser. No. 09/968,023, filed Oct. 2, 2001.

FIELD OF THE INVENTION

This invention relates to the anodization of light metals such as magnesium and aluminum to provide corrosion-, heat- and abrasion-resistant coatings. The invention is especially useful for forming white anodized coatings on aluminum substrates.

BACKGROUND OF THE INVENTION

Magnesium, aluminum and their alloys have found a variety of industrial applications. However, because of the reactivity of such light metals, and their tendency toward corrosion and environmental degradation, it is necessary to provide the exposed surfaces of these metals with an adequate corrosion-resistant and protective coating. Further, such coatings should resist abrasion so that the coatings remain intact during use, where the metal article may be subjected to repeated contact with other surfaces, particulate matter and the like. Where the appearance of articles fabricated of light metals is considered important, the protective coating applied thereto should additionally be uniform and decorative. Heat resistance is also a very desirable feature of a light metal protective coating.

In order to provide an effective and permanent protective coating on light metals, such metals have been anodized in a variety of electrolyte solutions. While anodization of aluminum, magnesium and their alloys is capable of forming a more effective coating than painting or enameling, the resulting coated metals have still not been entirely satisfactory for their intended uses. The coatings frequently lack the desired degree of hardness, smoothness, durability, adherence, heat resistance, corrosion resistance, and/or imperviousness required to meet the most demanding needs of industry. Additionally, many of the light metal anodization processes developed to date have serious shortcomings which hinder their industrial practicality. Some processes, for example, require the use of high voltages, long anodization times and/or volatile, hazardous substances.

In addition, it will often be desirable to provide an anodized coating on a light metal article that not only protects the metal surface from corrosion but also provides a decorative white finish so that the application of a further coating of white paint or the like can be avoided. Few anodization methods are known in the art to be capable of forming a white-colored decorative finish with high hiding power on aluminum articles, for example.

Thus, there is still considerable need to develop alternative anodization processes for light metals which do not have any of the aforementioned shortcomings and yet still furnish corrosion-, heat- and abrasion-resistant protective coatings of high quality and pleasing appearance.

SUMMARY OF THE INVENTION

Light metal-containing articles may be rapidly anodized to form protective coatings that are resistant to corrosion and abrasion using anodizing solutions containing complex fluorides and/or complex oxyfluorides. The use of the term "solution" herein is not meant to imply that every component present is necessarily fully dissolved and/or dispersed. The anodizing solution is aqueous and comprises one or more components selected from water-soluble and water-dispersible complex fluorides and oxyfluorides of elements selected from the group consisting of Ti, Zr, Hf, Si, Sn, Al, Ge and B.

The method of the invention comprises providing a cathode in contact with the anodizing solution, placing the light metal-containing article as an anode in the anodizing solution, and passing a current through the anodizing solution at a voltage and for a time effective to form the protective coating on the surface of the light metal-containing article. Where the article is comprised of magnesium, the current used should be pulsed. Pulsed direct current or alternating current is preferably used when the article is comprised of aluminum. When using pulsed current, the average voltage is preferably not more than 250 volts, more preferably, not more than 200 volts, or, most preferably, not more than 175 volts, depending on the composition of the anodizing solution selected. The peak voltage, when pulsed current is being used, is preferably not more than 500 volts, more preferably not more than 350 volts, most preferably not more than 250 volts.

DETAILED DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the scope of the invention. Practice within the numerical limits stated is generally preferred, however. Also, throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained at ambient room temperatures (18 to 25° C.).

There is no specific limitation on the light metal article to be subjected to anodization in accordance with the present invention. Preferably, at least a portion of the article is fabricated from a metal that contains not less than 50% by weight, more preferably not less than 70% by weight, magnesium or aluminum.

In carrying out the anodization of a light metal article, an anodizing solution is employed which is preferably maintained at a temperature between about 5° C. and about 90° C.

The anodization process comprises immersing at least a portion of the light metal article in the anodizing solution, which is preferably contained within a bath, tank or other such container. The light metal article functions as the anode. A second metal article that is cathodic relative to the light metal article is also placed in the anodizing solution. Alternatively, the anodizing solution is placed in a container which is itself cathodic relative to the light metal article (anode). When using pulsed current, an average voltage potential preferably not in excess of 250 volts, more preferably not in excess of 200 volts, most preferably not in excess of 175 volts is then applied across the electrodes until a coating of the desired thickness is formed on the surface of the light metal article in contact with the anodizing solution. When certain anodizing solution compositions are used, good results may be obtained even at average voltages not in excess of 125 volts. It has been observed that the formation of a corrosion- and abrasion-resistant protective coating is often associated with anodization conditions which are effective to cause a visible light-emitting discharge (sometimes referred to herein as a "plasma", although the use of this term is not meant to imply that a true plasma exists) to be generated (either on a continuous or intermittent or periodic basis) on the surface of the light metal article.

It has been found that the use of pulsed or pulsing current is critical when the article to be anodized is comprised predominantly of magnesium. Direct current is preferably used, although alternating current may also be utilized (under some conditions, however, the rate of coating formation may be lower using AC). The frequency of the current is not believed to be critical, but typically may range from 10 to 1000 Hertz. The "off" time between each consecutive voltage pulse preferably lasts between about 10% as long as the voltage pulse and about 1000% as long as the voltage pulse. During the "off" period, the voltage need not be dropped to zero (i.e., the voltage may be cycled between a relatively low baseline voltage and a relatively high ceiling voltage). The baseline voltage thus may be adjusted to a voltage which is from 0% to 99.9% of the peak applied ceiling voltage. Low baseline voltages (e.g., less than 30% of the peak ceiling voltage) tend to favor the generation of a periodic or intermittent visible light-emitting discharge, while higher baseline voltages (e.g., more than 60% of the peak ceiling voltage) tend to result in continuous plasma anodization (relative to the human eye frame refresh rate of 0.1–0.2 seconds). The current can be pulsed with either electronic or mechanical switches activated by a frequency generator. Typically, the current density will be from 100 to 300 amps/$m^2$. More complex waveforms may also be employed, such as, for example, a DC signal having an AC component.

Pulsed current as described above also provides good results when the article to be anodized is comprised predominantly of aluminum. However, the use of non-pulsed alternating current (typically, at voltage potentials of from 300 to 800) also typically results in the rapid formation of a corrosion-resistant coating on aluminum-containing articles when such articles are anodized using the anodizing solutions of the present invention. The use of alternating current is particularly preferred when the article to be anodized is comprised of a casting alloy such as A318, since more rapid film builds are possible as compared to the use of pulsed direct current. It is believed that the cathodic part of the AC cycle helps to clean impurities from the surface of the substrate, thereby accelerating the rate at which the anodized film can build on the surface.

Without wishing to be bound by theory, it is thought that the anodization of light metals in the presence of complex fluoride or oxyfluoride species to be described subsequently in more detail leads to the formation of surface films comprised of metal/metalloid oxide ceramics (including partially hydrolyzed glasses containing O, OH and/or F ligands) or light metal/non-metal compounds. The plasma or sparking which often occurs during anodization in accordance with the present invention is believed to destabilize the anionic species, causing certain ligands or substituents on such species to be hydrolyzed or displaced by O and/or OH or metal-organic bonds to be replaced by metal-O or metal-OH bonds. Such hydrolysis and displacement reactions render the species less water-soluble or water-dispersible, thereby driving the formation of the surface coating.

The anodizing solution used comprises water and at least one complex fluoride or oxyfluoride of an element selected from the group consisting of Ti, Zr, Hf, Si, Sn, Al, Ge and B (preferably, Ti, Zr and/or Si). The complex fluoride or oxyfluoride should be water-soluble or water-dispersible and preferably comprises an anion comprising at least 1 fluorine atom and at least one atom of an element selected from the group consisting of Ti, Zr, Hf, Si, Sn, Al, Ge or B. The complex fluorides and oxyfluorides (sometimes referred to by workers in the field as "fluorometallates") preferably are substances with molecules having the following general empirical formula (I):

$$H_pT_qF_rO_s \quad (I)$$

wherein: each of p, q, r, and s represents a non-negative integer; T represents a chemical atomic symbol selected from the group consisting of Ti, Zr, Hf, Si, Sn, Al, Ge, and B; r is at least 1; q is at least 1; and, unless T represents B, (r+s) is at least 6. One or more of the H atoms may be replaced by suitable cations such as ammonium, metal, alkaline earth metal or alkali metal cations (e.g., the complex fluoride may be in the form of a salt, provided such salt is water-soluble or water-dispersible).

Illustrative examples of suitable complex fluorides include, but are not limited to, $H_2TiF_6$, $H_2ZrF_6$, $H_2HfF_6$, $H_2SiF_6$, $H_2GeF_6$, $H_2SnF_6$, $H_3AlF_6$, and $HBF_4$ and salts (fully as well as partially neutralized) and mixtures thereof. Examples of suitable complex fluoride salts include $SrSiF_6$, $MgSiF_6$, $Na_2SiF_6$ and $Li_2SiF_6$.

The total concentration of complex fluoride and complex oxyfluoride in the anodizing solution preferably is at least about 0.005 M. Generally speaking, there is no preferred upper concentration limit, except of course for any solubility constraints.

To improve the solubility of the complex fluoride or oxyfluoride, especially at higher pH, it may be desirable to include an inorganic acid (or salt thereof) that contains fluorine but does not contain any of the elements Ti, Zr, Hf, Si, Sn, Al, Ge or B in the electrolyte composition. Hydrofluoric acid or a salt of hydrofluoric acid such as ammonium bifluoride is preferably used as the inorganic acid. The inorganic acid is believed to prevent or hinder premature polymerization or condensation of the complex fluoride or oxyfluoride, which otherwise (particularly in the case of complex fluorides having an atomic ratio of fluorine to T of 6) may be susceptible to slow spontaneous decomposition to form a water-insoluble oxide. Certain commercial sources of hexafluorosilicic acid, hexafluorotitanic acid and hexafluorozirconic acid are supplied with an inorganic acid or salt thereof, but it may be desirable in certain embodiments of the invention to add still more inorganic acid or inorganic salt. A chelating agent, especially a chelating agent containing two or more carboxylic acid groups per molecule such as nitrilotriacetic acid, ethylene diamine tetraacetic acid, N-hydroxyethyl-ethylenediamine triacetic acid, or diethylene-triamine pentaacetic acid or salts thereof, may also be included in the anodizing solution.

Suitable complex oxyfluorides may be prepared by combining at least one complex fluoride with at least one compound which is an oxide, hydroxide, carbonate, carboxylate or alkoxide of at least one element selected from the group consisting of Ti, Zr, Si, Hf, Sn, B, Al, or Ge. Salts of such compounds may also be used (e.g., titanates, zirconates, silicates). Examples of suitable compounds of this type which may be used to prepare the anodizing solutions of the present invention include, without limitation, silica, zirconium basic carbonate, zirconium acetate and zirconium hydroxide. The preparation of complex oxyfluorides suitable for use in the present invention is described in U.S. Pat. No. 5,281,282, incorporated herein by reference in its entirety.

The concentration of this compound used to make up the anodizing solution is preferably at least, in increasing preference in the order given, 0.0001, 0.001 or 0.005 moles/kg (calculated based on the moles of the element(s) Ti, Zr, Si, Hf, Sn, B, Al and/or Ge present in the compound used). Independently, the ratio of the concentration of moles/kg of complex fluoride to the concentration in moles/kg of the oxide, hydroxide, carbonate or alkoxide compound preferably is at least, with increasing preference in the order given, 0.05:1, 0.1:1, or 1:1.

In general, it will be preferred to maintain the pH of the anodizing solution in this embodiment of the invention in the range of from mildly acidic to mildly basic (e.g., a pH of from about 5 to about 11). A base such as ammonia, amine or alkali metal hydroxide may be used, for example, to adjust the pH of the anodizing solution to the desired value. Rapid coating formation is generally observed at average voltages of 125 volts or less (preferably 100 or less), using pulsed DC.

A particularly preferred anodizing solution for use in forming a white protective coating on an aluminum or aluminum alloy substrate may be prepared using the following components:

| | |
|---|---|
| Zirconium Basic Carbonate | 0.01 to 1 wt. % |
| $H_2ZrF_6$ | 0.1 to 5 wt. % |
| Water | Balance to 100% |

pH Adjusted to the Range of 3 to 5 Using Ammonia, Amine or Other Base

It is believed that the zirconium basic carbonate and the hexafluorozirconic acid combine to at least some extent to form one or more complex oxyfluoride species. The resulting anodizing solution permits rapid anodization of light metal-containing articles using pulsed direct current having an average voltage of not more than 100 volts. In this particular embodiment of the invention, better coatings are generally obtained when the anodizing solution is maintained at a relatively high temperature during anodization (e.g., 50 degrees C. to 80 degrees C.). Alternatively, alternating current preferably having a voltage of from 300 to 600 volts may be used. The solution has the further advantage of forming protective coatings which are white in color, thereby eliminating the need to paint the anodized surface if a white decorative finish is desired. The anodized coatings produced in accordance with this embodiment of the invention typically have high L values, high hiding power at coating thicknesses of 4 to 8 microns, and excellent corrosion resistance. To the best of the inventor's knowledge, no anodization technologies being commercially practiced today are capable of producing coatings having this desirable combination of properties.

Before being subjected to anodic treatment in accordance with the invention, the light metal article preferably is subjected to a cleaning and/or degreasing step. For example, the article may be chemically degreased by exposure to an alkaline cleaner such as, for example, a diluted solution of PARCO Cleaner 305 (a product of the Henkel Surface Technologies division of Henkel Corporation, Madison Heights, Mich.). After cleaning, the article preferably is rinsed with water. Cleaning may then, if desired, be followed by etching with an acid, such as, for example, a dilute aqueous solution of an acid such as sulfuric acid, phosphoric acid, and/or hydrofluoric acid, followed by additional rinsing prior to anodization. Such pre-anodization treatments are well known in the art.

The protective coatings produced on the surface of the light metal article may, after anodization, be subjected to still further treatments such as painting, sealing and the like. For example, a dry-in-place coating such as a silicone or a PVDF waterborne dispersion may be applied to the anodized surface, typically at a film build (thickness) of from about 3 to about 30 microns.

EXAMPLES

Examples 1–2

Anodizing solutions were prepared using the components shown in Table 1, with the pH of the solution being adjusted to 8.0 using ammonia (Example 1 required 5.4 g concentrated aqueous ammonia).

The anodizing solution of Example 2 was used to anodize 1"×4" samples of AZ91 magnesium alloy. A visible light-emitting discharge which was green in color was observed when 60 Hz AC was applied at 88 volts (peak voltage controlled by means of a VARIAC voltage control apparatus) at 7–9 amperes. After 5 minutes of anodization, a coating 0.07 mils in thickness had been formed. Using pulsed square wave DC (approximate shape, 10 milliseconds on and 30 milliseconds off, with 0 volts as the minimum). the discharge was periodic and white in color. Average voltage was 30 volts (average peak voltage=200 volts, with transient peak at 300 volts). The rate of coating formation (typically, 0.2 to 0.4 mils in 2 minutes) was much higher than when 60 Hz AC was employed.

TABLE 1

| Example | 1 | 2 |
|---|---|---|
| $H_2TiF_6$, g | 80.0 | — |
| $H_2ZrF_6$ (20% aq. Solution), g | — | 175 |
| Ammonium Bifluoride, g | 7.0 | 7.0 |
| Deionized Water, g | 780 | 740 |
| Chelating Agent[1], g | 10.0 | — |

[1]VERSENE 100, a product of Dow Chemical Company

Example 3

An anodizing solution was prepared using 10 g/L sodium fluosilicate ($Na_2SiF_6$), the pH of the solution being adjusted to 9.7 using KOH. A magnesium-containing article was subjected to anodization for 45 seconds in the anodizing solution using pulsed direct current having a peak ceiling voltage of 440 volts (approximate average voltage=190 volts). The "on" time was 10 milliseconds, the "off" time was 10 milliseconds (with the "off" or baseline voltage being 50% of the peak ceiling voltage). A uniform coating 3.6 microns in thickness was formed on the surface of the magnesium-containing article. During anodization, the plasma generated was initially continuous, but then became periodic.

Example 4

A magnesium-containing article was subjected to anodization for 45 seconds in the anodizing solution of Example 3 using pulsed direct current having a peak ceiling voltage of 500 volts (approximate average voltage=75 volts). The "on" time was 10 milliseconds, the "off" time was 30 milliseconds (with the "off" or baseline voltage being 0% of the peak ceiling voltage). A uniform coating 5.6 microns in thickness was formed on the surface of the magnesium-containing article. During anodization, the plasma generated was initially continuous, but then become periodic.

Example 5

An anodizing solution was prepared using the following components:

| | Parts by Weight |
|---|---|
| Zirconium Basic Carbonate | 5.24 |
| Fluozirconic Acid (20% solution) | 80.24 |
| Deionized Water | 914.5 |

The pH was adjusted to 3.9 using ammonia. An aluminum-containing article was subjected to anodization for 120 seconds in the anodizing solution using pulsed direct current having a peak ceiling voltage of 450 volts (approximate average voltage=75 volts). The other anodization conditions were as described in Example 4. A uniform white coating 6.3 microns in thickness was formed on the surface of the aluminum-containing article. A periodic to continuous plasma (rapid flashing just visible to the unaided human eye) was generated during anodization.

Example 6

An aqueous anodizing solution was prepared using 20% $H_2ZrF_6$ (42.125 g/L) and zirconium basic carbonate (2.75 g/L), with the pH being adjusted to 3.5 using ammonia. An article comprised of 6063 aluminum (a casting alloy) was subjected to anodization for 1 minute using alternating current (460 volts, 60 Hz). A white zirconium-containing coating 8 to 10 microns in thickness was formed on the surface of the article.

Example 7

An aluminum surface having a white anodized coating on its surface (formed using pulsed direct current and an anodizing solution containing a complex oxyfluoride of zirconium) is sealed using General Electric SHC5020 silicone as a dry-in-place coating. At a film build of 5 to 8 microns, no change in the appearance of the anodized coating is observed. No corrosion occurs during a 3000 hour salt fog test.

Example 8

An aluminum surface as described in Example 7 is sealed using ZEFFLE SE310 waterborne PVDF dispersion (Daikin Industries Ltd., Japan) as a dry-in-place coating. At a film build of 14 to 25 microns, no change in the appearance of the anodized coating is observed. No corrosion occurs during a 3000 hour salt fog test.

What is claimed is:

1. A method of forming a protective coating on a surface of a light metal-containing article, said method comprising:

A) providing an anodizing solution comprised of water and one or more additional components selected from the group consisting of water-soluble and water-dispersible complex fluorides and oxyfluorides of elements selected from the group consisting of Ti, Zr, Hf, Si, Sn, Al, Ge and B;

B) providing a cathode in contact with said anodizing solution;

C) placing said light metal-containing article as an anode in said anodizing solution; and D) passing a current between the anode and cathode though said anodizing solution for a time effective to form said protective coating on said surface.

2. The method of claim 1 wherein the light metal-containing article is comprised of magnesium.

3. The method of claim 1 wherein the light metal-containing article is comprised of aluminum.

4. The method of claim 1 wherein said anodizing solution is maintained at a temperature of from 5° C. to 90° C. during step (D).

5. The method of claim 1 wherein said light metal-containing article is comprised of magnesium and said current is pulsed direct current having an average voltage of not more than 200 volts.

6. The method of claim 1 wherein a visible light-emitting discharge is generated during step (D).

7. The method of claim 1 wherein during step (D) said protective coating is formed at a rate of at least 1 micron thickness per minute.

8. The method of claim 1 wherein said light metal-containing article is comprised of aluminum and said current is pulsed direct current or alternating current.

9. The method of claim 1 wherein said light metal-containing article is comprised of aluminum and said protective coating is white in color.

10. The method of claim 1 wherein said current is pulsed direct current.

11. The method of claim 1 wherein the anodizing solution is prepared using a complex fluoride selected from the group consisting of $H_2TiF_6$, $H_2ZrF_6$, $H_2HfF_6$, $H_2SiF_6$, $H_2GeF_6$, $H_2SnF_6$, $H_2GeF_6$, $H_3AlF_6$, $HBF_4$ and salts and mixtures thereof.

12. The method of claim 1 wherein the anodizing solution is additionally comprised of HF or a salt thereof.

13. The method of claim 1 wherein the anodizing solution is additionally comprised of a chelating agent.

14. The method of claim 1 wherein the anodizing solution is prepared using an amine, ammonia, or mixture thereof.

15. A method of forming a protective coating on a surface of a metallic article comprised predominantly of aluminum or magnesium, said method comprising:

A) providing an anodizing solution comprised of water and a water-soluble complex fluoride or oxyfluoride of an element selected from the group consisting of Ti, Zr, Si, and combinations thereof;

B) providing a cathode in contact with said anodizing solution;

C) placing said metallic article as an anode in said anodizing solution; and

D) passing a pulsed direct current having an average voltage of not more than 125 volts or an alternating current between the anode and the cathode for a time effective to form said protective coating on said surface.

16. The method of claim 15 wherein the anodizing solution is prepared using a complex fluoride comprising an anion comprising at least 4 fluorine atoms and at least one atom selected from the group consisting of Ti, Zr, Si, and combinations thereof.

17. The method of claim 15 wherein the anodizing solution is prepared using a complex fluoride selected from the group consisting of $H_2TiF_6$, $H_2ZrF_6$, $H_2SiF_6$, and salts and mixtures thereof.

18. The method of claim 15 wherein said complex fluoride is introduced into the anodizing solution at a concentration of at least 0.1 M.

19. The method of claim 15 wherein the anodizing solution is additionally comprised of hydrofluoric acid, a salt of hydrofluoric acid, or a mixture thereof.

20. The method of claim 15 wherein the anodizing solution is additionally comprised of a chelating agent.

21. The method of claim 15 wherein the anodizing solution is comprised of at least one complex oxyfluoride prepared by combining at least one complex fluoride of at least one element selected from the group consisting of Ti, Zr, and Si and at least one compound which is an oxide, hydroxide, carbonate or alkoxide of at least one element selected from the group consisting of Ti, Zr, Si, Hf, Sn, B, Al and Ge.

22. The method of claim 15 wherein the anodizing solution has a pH of from about 3 to about 11.

23. A method of forming a protective coating on a surface of a metallic article comprised of aluminum, magnesium or a mixture thereof, said method comprising:

A) providing an anodizing solution, said anodizing solution having been prepared by dissolving a water-soluble complex fluoride or oxyfluoride of an element selected from the group consisting of Ti, Zr, Hf, Si, Sn, Ge, B and combinations thereof and an inorganic acid or salt thereof that contains fluorine but does not contain any of the elements Ti, Zr, Hf, Si, Sn, Ge or B in water and said anodizing solution having a pH of from about 3 to about 11;

B) providing a cathode in contact with said anodizing solution;

C) placing said metallic article as an anode in said anodizing solution; and

D) passing a pulsed direct current having an average voltage of not more than 125 volts or an alternating current between the anode and the cathode for a time effective to form said protective coating on said surface.

24. The method of claim 23 wherein the pH of the anodizing solution is adjusted using ammonia, an amine, an alkali metal hydroxide or a mixture thereof.

25. The method of claim 23 wherein the inorganic acid is hydrogen fluoride or a salt thereof.

26. The method of claim 23 wherein the anodizing solution is additionally comprised of a chelating agent.

27. The method of claim 23 wherein at least one compound which is an oxide, hydroxide, carbonate or alkoxide of at least one element selected from the group consisting of Ti, Zr, Si, Hf, Sn, B, Al and Ge is additionally used to prepare said anodizing solution.

28. A method of forming a white protective coating on a surface of a metallic article comprised predominantly of aluminum, said method comprising:

A) providing an anodizing solution, said anodizing solution having been prepared by combining a water-soluble complex fluoride of zirconium or salt thereof and an oxide, hydroxide, carbonate or alkoxide of zirconium in water and said anodizing solution having a pH of from about 3 to 5;

B) providing a cathode in contact with said anodizing solution;

C) placing said metallic article as an anode in said anodizing solution; and

D) passing a pulsed direct current having an average voltage of not more than 125 volts or an alternating current between the anode and the cathode for a time effective to form said white protective coating on said surface.

29. The method of claim 28 wherein $H_2ZrF_6$ or a salt thereof is used to prepare the anodizing solution.

30. The method of claim 28 wherein zirconium basic carbonate is used to prepare the anodizing solution.

31. The method of claim 28 wherein the pH of the anodizing solution is adjusted using a base.

32. The method of claim 28 wherein the anodizing solution has been prepared by combining about 0.1 to about 1 weight percent zirconium basic carbonate and about 10 to about 16 weight percent $H_2ZrF_6$ or salt thereof in water and adding a base if necessary to adjust the pH of the anodizing solution to between about 3 and about 5.

* * * * *

UNITED STATES PATENT AND TRADEMARK OFFICE

CERTIFICATE OF CORRECTION

PATENT NO. : 6,797,147 B2
DATED : September 28, 2004
INVENTOR(S) : Dolan

It is certified that error appears in the above-identified patent and that said Letters Patent is hereby corrected as shown below:

Title page,
Item [56], References Cited, FOREIGN PATENT DOCUMENTS,
add -- JP 59016994 1/84 --.

Signed and Sealed this

Twenty-fifth Day of April, 2006

JON W. DUDAS
*Director of the United States Patent and Trademark Office*